US011319955B2

(12) United States Patent
Bariau et al.

(10) Patent No.: US 11,319,955 B2
(45) Date of Patent: May 3, 2022

(54) POSITIVE DISPLACEMENT PUMP WITH IMPROVED CLEANING

(71) Applicant: Mouvex, Auxerre (FR)

(72) Inventors: Fabrice Bariau, Arras (FR); Yann Besnier, Lindry (FR)

(73) Assignee: MOUVEX, Auxerre (FR)

( * ) Notice: Subject to any disclaimer, the term of this patent is extended or adjusted under 35 U.S.C. 154(b) by 60 days.

(21) Appl. No.: 16/770,350

(22) PCT Filed: Nov. 7, 2018

(86) PCT No.: PCT/FR2018/052748
§ 371 (c)(1),
(2) Date: Jun. 5, 2020

(87) PCT Pub. No.: WO2019/115890
PCT Pub. Date: Jun. 20, 2019

(65) Prior Publication Data

US 2020/0386226 A1 Dec. 10, 2020

(30) Foreign Application Priority Data

Dec. 14, 2017 (FR) ..... 1762157

(51) Int. Cl.
*F04C 15/00* (2006.01)
*F04C 15/06* (2006.01)

(52) U.S. Cl.
CPC ..... *F04C 15/0065* (2013.01); *F04C 15/06* (2013.01); *F04C 2210/206* (2013.01);
(Continued)

(58) Field of Classification Search
CPC ... F04C 15/0065; F04C 15/06; F04C 2280/00
See application file for complete search history.

(56) References Cited

U.S. PATENT DOCUMENTS 1,497,050 A 6/1924 Wardwell
3,560,119 A * 2/1971 Busch ..... F01C 21/008 418/55.3

(Continued)

FOREIGN PATENT DOCUMENTS

WO 9736107 A1 10/1997

OTHER PUBLICATIONS

International Search Report and Written Opinion for PCT Patent App. No. PCT/FR2018/052748 (dated Jan. 21, 2019) with English translation of the ISR.

*Primary Examiner* — Mary Davis
(74) *Attorney, Agent, or Firm* — Kenealy Vaidya LLP

(57) ABSTRACT

Some embodiments are directed to a positive displacement pump comprising: a pipe having a first end secured to a transmission area and a second end ending in a cylinder secured to a discharge area, the pipe comprising a suction opening and the discharge area comprising a discharge opening, a drive shaft with one end situated at the cylinder, a piston pressed against the cylinder by elastic means so as to prevent fluid from moving between the pipe and the discharge area, in which the pump further comprises means for moving the piston elastically away from the cylinder and keeping it at a predetermined distance from same. Some other embodiments are directed to a method for cleaning this pump.

10 Claims, 2 Drawing Sheets

(52) U.S. Cl.
CPC .... *F04C 2210/221* (2013.01); *F04C 2240/60* (2013.01); *F04C 2280/00* (2013.01)

(56) References Cited

U.S. PATENT DOCUMENTS 3,671,143 A * 6/1972 Clark ..... F04C 15/06 417/79
3,802,809 A * 4/1974 Vulliez ..... F04C 18/0215 418/5
5,983,738 A * 11/1999 Delaisse ..... F04C 15/0065 74/18.1
6,884,047 B1 * 4/2005 Liepert ..... F04C 18/0215 418/5

* cited by examiner

POSITIVE DISPLACEMENT PUMP WITH IMPROVED CLEANING

CROSS REFERENCE TO RELATED APPLICATIONS

This application is a national phase filing under 35 C.F.R. § 371 of and claims priority to PCT Patent Application No. PCT/FR2018/052748 filed on Nov. 7, 2018, which claims the priority benefit under 35 U.S.C. § 119 of French Patent Application No. 10 2016 204 177.0 filed on Dec. 14, 2017, the contents of each of which are hereby incorporated in their entireties by reference.

BACKGROUND

Some embodiments of the presently disclosed subject matter relate to the field of pumps, in particular eccentric piston positive displacement pumps. Some other embodiments of the presently disclosed subject matter relate more particularly to a pump including improved means for in situ cleaning.

In some industrial fields, for example the foodstuffs industry, pumps are cleaned without demounting them. An auxiliary pump sends a cleaning liquid through the pump. This method is known as in situ cleaning.

The pumps liable to be cleaned by this method include positive displacement pumps.

An eccentric piston positive displacement pump generally includes a cylinder including a suction port and sharing one end with a discharge area. At the level of this end a piston is mounted to slide on the end of a drive shaft and is pressed against the cylinder by pressing means, such as springs, thus blocking the passage of fluid.

During in situ cleaning the pressure generated by the auxiliary pump enables the piston to be lifted from the cylinder and consequently enables the passage of a flow of cleaning liquid. However, the resistance of the pressing means reduces the distance of this lift, therefore inducing head losses in the installation, which prevents the passage of all or most of the cleaning flow through the pump.

This effect is particularly accentuated in eccentric piston positive displacement pumps including a sleeve surrounding the shaft and formed of bellows the interior of which remains at atmospheric pressure. A sleeve of this kind being subjected externally to the pressure of the cleaning liquid, it then exerts a force in the same direction as the pressing means. The combined action on the piston of the pressing means and the sleeve therefore further reduces the lift distance between the cylinder and the piston and therefore increases the head loss generated by the pump.

To limit these head losses it is generally necessary to install an external pipe network with a valve for diverting a fraction of the cleaning flow that is great than the maximum flow of the pump. This therefore complicates installation and in situ cleaning.

SUMMARY

Some embodiments of the presently disclosed subject matter therefore propose a positive displacement pump enabling simplified in situ cleaning, and a method of cleaning a pump of this kind.

Accordingly, some embodiments therefore can include or can consist of an eccentric piston positive displacement pump including:

- a pipe having a first end secured to a transmission area and a second end ending in a cylinder secured to a discharge area, the pipe including a suction port and the discharge area including a discharge port,
- a drive shaft extending between the transmission area and the pipe with one end situated at the cylinder,
- a piston arranged in the discharge area and mounted to slide at the end of the shaft and being pressed against the cylinder by elastic means so as to prevent fluid from moving between the pipe and the discharge area.

According to some embodiments the pump further includes means for moving the piston elastically away from the cylinder and keeping it at a predetermined distance from same.

By immobilizing the piston in the position lifted off the cylinder, the pump behaves like an open valve and there is no longer any need to install a branch connection system. All or most of the cleaning flow is therefore able to pass from the suction port to the discharge port. Consequently, the head loss becomes very small and in situ cleaning is simplified.

The predetermined distance is advantageously between 2 and 10 mm inclusive.

This distance determined experimentally and by simulations as sufficient distance for all or most of the cleaning flow to pass through the pump. This variation of the distance is a function of the size of the pump.

In accordance with some embodiments, the pump further includes a sleeve arranged in the pipe around the shaft. This sleeve includes at least one metal bellows that is sealingly fixed by first fixing means to the first end of the pipe and by second fixing means to the end of the shaft, in such a manner as to prevent the transmission of fluids from the pipe toward the shaft.

The means for moving the piston away from the cylinder are advantageously pneumatic means adapted to pressurize the sleeve.

In this way, the internal part of the sleeve is pressurized, which enables the piston to be lifted sufficiently from the cylinder and maintained at a distance from same.

The pneumatic means advantageously include a pressurization pot communicating with the sleeve via the transmission area, the pressurization pot containing an oil and is intended to be connected to a source of compressed air.

The pressurization pot enables the transmission area to be filled completely; it is also filled partly so that the oil level is in the pressurization pot. Thereafter, by connecting this pressurization pot to a source of compressed air, the resulting pneumatic pressure acts on this oil surface as on a piston.

The volume of oil is therefore transferred from the pressurization pot to the transmission area and then to the sleeve. The increased volume of the sleeve enables it to be lengthened and thus the piston to be caused to slide so as to move it away from the cylinder. The distance of this movement away may be adjusted by adjusting the pressure in the pressurization pot.

Moreover, by maintaining the pressure in the pressurization pot, the distance between the cylinder and the piston is also maintained substantially fixed. In this way, when the cleaning liquid is circulated between the suction port and the discharge port the head loss becomes very small.

The pressurization pot advantageously includes restriction means adapted to restrict the passage of fluid from the pot to the transmission area and vice versa.

By way of example, the restriction means may include an oil flow reducing valve, a controllable solenoid valve.

This restriction of passage of oil toward the transmission area and vice versa has the effect of maintaining the piston lifted off the cylinder during pressure peaks around the bellows likely to be generated during circulation of the cleaning liquid. In fact, these restriction means enable slow movement of oil between the pressurization pot and the transmission area, thus preventing any sudden change in the volume of the sleeve.

The elastic means fixing the piston to the end of the shaft advantageously include at least one axial spring. This spring serves to press the piston against the cylinder, in particular during priming phases. During pumping phases, the discharge pressure also contributes to pressing the piston against the cylinder.

A spring of this kind may for example be formed by an assembly of spring washers.

The pump advantageously includes at least one abutment adapted to protect the axial spring. In particular during phases in which the transmission area is pressurized.

Some embodiments also relate to a method of cleaning a pump conforming to at least one of the pumps described above in which the means for moving the piston elastically away from the cylinder are used and a cleaning fluid is then circulated between the suction port and the discharge port.

BRIEF DESCRIPTION OF THE FIGURES

Some embodiments will be better understood on reading the following description of embodiments given by way of nonlimiting illustration, the description referring to the appended drawings in which.

DETAILED DESCRIPTION OF EXEMPLARY EMBODIMENTS

Figure 1:
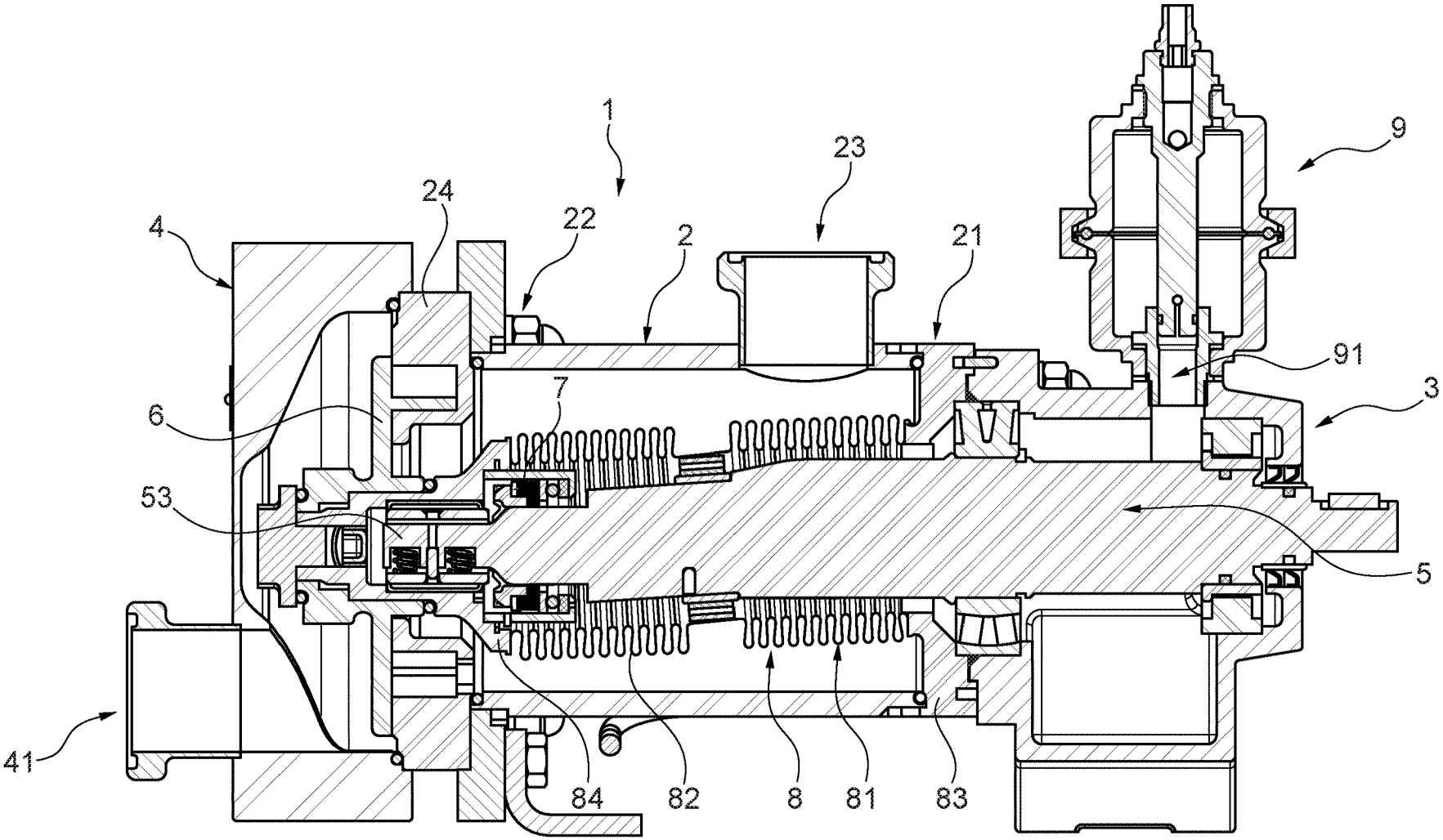
FIG. 1 represents a view in longitudinal section of a pump in accordance with some embodiments of the presently disclosed subject matter.

FIG. 1 represents an eccentric piston positive displacement pump 1 according to some embodiments seen in longitudinal section.

The pump 1 includes a pipe 2 having a first end 21, a second end 22 and a suction port 23.

The first end 21 is secured to a transmission area 3 that contains transmission means of the pump 1. The second end 22 includes a cylinder 24 and is secured to a discharge area 4 that includes a discharge port 41.

A drive shaft 5 extends in the pipe 2 from the transmission area 3. The end 53 of the shaft 5 is located at the level of the cylinder 24.

As can be seen in FIG. 1, in this embodiment a sleeve 8 is arranged in the cylinder 2 around the shaft 5. The sleeve 8 includes a metal, for example steel, bellows in two parts 81, 82. The sleeve 8 is sealingly fixed by first fixing means 83 to the first end 21 of the pipe 2 and by second fixing means 84 to the end 53 of the shaft. A sleeve of this kind is known in itself to one of ordinary skill in the art. It is for example described in detail in the document WO97/36107.

A piston 6 in the discharge area 4 is mounted to slide on the end 53 of the shaft 5 and retained by an axial spring 7 that presses it against the cylinder 24 in such a manner as to block movement of fluid between the pipe 2 and the discharge area 4.

The second fixing means 84 of the sleeve are also secured to the piston and can therefore slide on the end 53 of the shaft 5 at the same time as the piston.

The operation of a pump of this kind when not being cleaned is also known to one of ordinary skill in the art. During in situ cleaning, the pump either rotating or being stationary, an auxiliary pump, not shown, is connected to the suction port 23 to send a cleaning liquid intended to pass through the pump and to leave from the discharge port 41.

As explained hereinabove, with the classic cleaning methods head losses are caused by the action of the axial spring 7 and the bellows 8 limiting the movement of the piston 6 relative to the cylinder 2 caused by the effect of the pressure of the cleaning liquid.

To solve this problem the pump 1 according to some embodiments include means for moving the piston 6 away from the cylinder 2 and maintaining it at a predetermined distance from the latter to enable movement of the cleaning fluid between the pipe 2 and the discharge area 4.

The pump according to some embodiments as represented by FIG. 1 more particularly includes a pressurization pot 9 communicating with the transmission area 3.

In known pumps the transmission area is filled with lubricating oil up to a certain level.

Adding the pressurization pot 9 to the pump 1 enables the transmission area 3 to be filled completely with oil and the oil level rises to a certain level in the pressurization pot 9.

During in situ cleaning of the pump the pressurization pot 9 is connected to a source of compressed air, not shown. Control means enable control of the pneumatic pressure generated by the compressed air that acts on the oil surface as on a piston.

The volume of oil is therefore transferred from the pressurization pot to the transmission area and then to the sleeve. The increase in the volume of the sleeve enables it to be lengthened and causes the piston to slide away from the cylinder. The distance it slides may be adjusted by adjusting the level of pressure in the pressurization pot.

Moreover, by maintaining the pressure in the pressurization pot, the distance between the cylinder and the piston is also maintained substantially fixed.

Thus all or most of the cleaning liquid is able to pass from the suction port to the discharge port with a reduced head loss.

The sufficient distance is dependent on the size of the pump. It is preferably between 2 and 10 mm.

Moreover, the pressurization pot 9 includes restriction means 91 enabling control of the movement of oil between the pressurization pot 9 and the transmission area.

In the example from FIG. 1 the restriction means 91 include an oil flow reducing valve.

In variants that are not shown the restriction means 91 may be different, for example a controllable solenoid valve.

Controlling the passage of oil enables the piston to be maintained lifted off the cylinder during pressure peaks around the bellows liable to be generated during circulation of the cleaning liquid.

Figure 2:
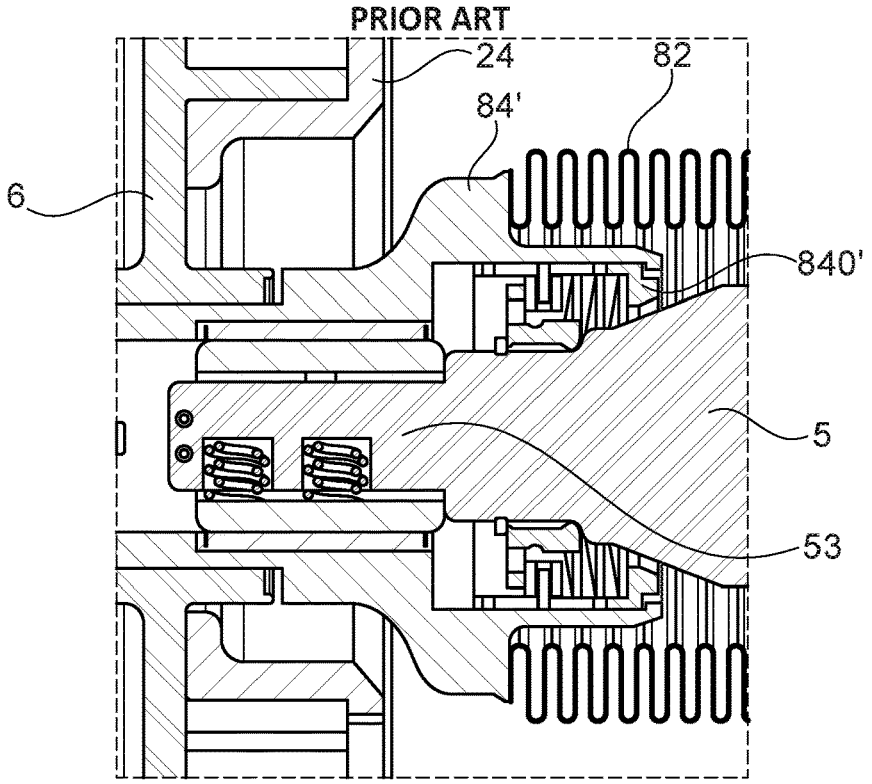
FIG. 2 represents an enlarged view of the transmission shaft end of a known positive displacement pump.
Figure 3:
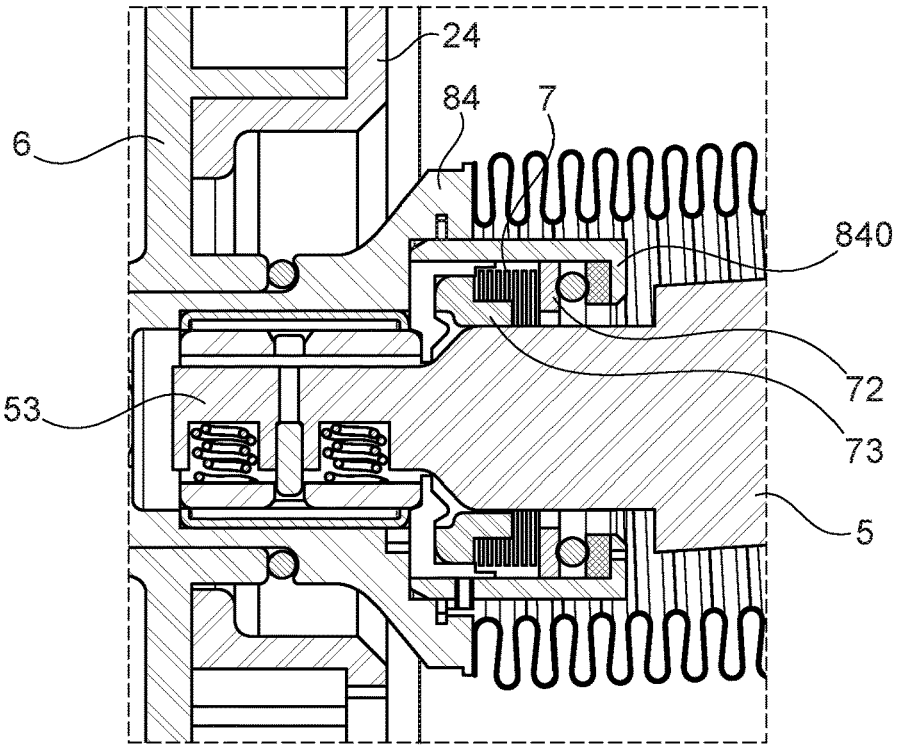
FIG. 3 represents a view similar to that in FIG. 2 on a pump conforming to an embodiment of some embodiments of the presently disclosed subject matter.

FIGS. 2 and 3 represent an enlarged view of the end 53 of the shaft 5 respectively in a known pump and in an improved pump according to some embodiments.

As seen in FIGS. 2, 3 the second fixing means 84, 84' are secured to the piston 6, the axial spring 71 acts on the end 840, 840' of the second fixing means 84, 84' to press the piston 6 against the cylinder 24.

In the case of FIG. 2, when the volume of the sleeve 8 increases, the piston 6 and the second fixing means 84' slide so that the piston 6 is moved away from the cylinder 24.

Because of the effect of the pressure that is rising in the sleeve, the end 840' crushes the turns of the spring, or the washers in the case of spring washers, and can therefore cause them to break.

To protect the spring 71 from breaking the pump represented in FIG. 3 provides an abutment composed of two parts 72, 73 respectively secured to the end 840 of the second fixing means 84 and to the end 53 of the shaft 5. Thus when the two parts 72, 73 of the abutment are in contact movement of the piston is stopped and the pressure on the spring does not increase.

Some embodiments are obviously not limited to the example shown. In variants that are not represented the pump need not include a sleeve. The means for moving the piston 6 away from the cylinder 2 and maintaining it at a predetermined distance may be different, for example controlled mechanical means.

Some other embodiments also relate to a method of cleaning a pump 1 according to some embodiments including at least some of the features described hereinabove, in which method the means for moving the piston 6 elastically away from the cylinder 24 are used, after which a cleaning fluid is circulated between the suction port 23 and the discharge port 41.

The invention claimed is:

1. An eccentric piston positive displacement pump, comprising:

a pipe having a first end secured to a transmission area and a second end ending in a cylinder secured to a discharge area, the pipe comprising a suction port and the discharge area comprising a discharge port, a drive shaft extending between the transmission area and the pipe with one end situated at the cylinder, and a piston arranged in the discharge area and mounted to slide at the end of the shaft and being pressed against the cylinder by elastic means so as to prevent fluid from moving between a pipe and the discharge area, wherein the pump further includes means for moving the piston elastically away from the cylinder and keeping the piston at a predetermined distance from the cylinder.

2. The pump as claimed in claim 1, wherein the predetermined distance is between 2 mm and 10 mm inclusive.

3. The pump as claimed in claim 1, further comprising a sleeve arranged in the pipe around the shaft and comprising at least one metal bellows that is sealingly fixed by first fixing means to the first end of the pipe and by second fixing means to said end of the shaft, so as to prevent the transmission of fluids from the pipe toward the shaft.

4. The pump as claimed in claim 3, wherein the means for moving the piston away from the cylinder are pneumatic means adapted to pressurize the sleeve.

5. The pump as claimed in claim 4, wherein the pneumatic means comprise a pressurization pot communicating with the sleeve via the transmission area, said pressurization pot contains an oil and is connected to a source of compressed air.

6. The pump as claimed in claim 5, wherein the pressurization pot comprises restriction means adapted to restrict the passage of fluid from the pot to the transmission area and vice versa.

7. The pump as claimed in claim 6, wherein the restriction means comprise an oil flow reducing valve.

8. The pump as claimed in claim 1, wherein the elastic means fixing the piston to the end of the shaft comprise at least one axial spring.

9. The pump as claimed in claim 8, comprising at least one abutment adapted to protect the axial spring.

10. A method of cleaning the pump as claimed in claim 1, wherein a cleaning step comprises the means for elastically moving the piston away from the cylinder moves the piston away from the cylinder and a cleaning fluid is then circulated between the suction port and the discharge port.

* * * * *